US007461575B2

(12) United States Patent
Tribby

(10) Patent No.: US 7,461,575 B2
(45) Date of Patent: Dec. 9, 2008

(54) SPARK PLUG WRENCH FOR CONFINED SPACES

(76) Inventor: Jerry Walter Tribby, 2072 Spring Place Rd., Lewisburg, TN (US) 37091

( * ) Notice: Subject to any disclaimer, the term of this patent is extended or adjusted under 35 U.S.C. 154(b) by 0 days.

(21) Appl. No.: 11/895,946

(22) Filed: Aug. 28, 2007

(65) Prior Publication Data

US 2008/0006129 A1 Jan. 10, 2008

Related U.S. Application Data

(63) Continuation-in-part of application No. 11/411,322, filed on Apr. 26, 2006, now abandoned.

(51) Int. Cl.
*B25B 23/16* (2006.01)

(52) U.S. Cl. ..... 81/177.8; 81/124.3

(58) Field of Classification Search ..... 81/177.7–177.9, 81/124.3; D8/21, 28, 29
See application file for complete search history.

(56) References Cited

U.S. PATENT DOCUMENTS

| | | | | |
|---|---|---|---|---|
| 2,549,515 | A * | 4/1951 | Orey et al. | 81/124.3 |
| 3,670,605 | A * | 6/1972 | Heim et al. | 81/125 |
| 3,680,159 | A * | 8/1972 | Wharram | 7/100 |
| 6,899,002 | B2 * | 5/2005 | Willis, Sr. | 81/177.7 |

* cited by examiner

*Primary Examiner*—D. S Meislin
(74) *Attorney, Agent, or Firm*—James Richards

(57) ABSTRACT

A spark plug installation and removal wrench comprising a short socket with a handle pivotally attached to the socket, forming a compact assembly that can access spark plugs in tight spaces. The socket may be rotated on the pivot axis to slip over the spark plug and down to engage and drive the spark plug. Lateral force on the handle may then rotate the socket to install or remove the spark plug. In one embodiment, the handle pivot axis may run through a clearance space for the spark plug, and the handle may have a U shape to avoid interference with the spark plug. An embodiment is disclosed wherein the handle may be attached with roll pins, rivets, screws or other pivot attachment hardware.

20 Claims, 9 Drawing Sheets

116
108
910
908
114
107
102
404

904
906
102
114

104
202
204
106a
106b
902
114
102

114
102

404
102
114
905

SPARK PLUG WRENCH FOR CONFINED SPACES

RELATED APPLICATIONS

This application is a continuation in part of prior application Ser. No. 11/411,322 titled "Spark Plug Wrench for Confined Spaces," filed Apr. 26, 2006 by Tribby, now abandoned which is incorporated herein by reference in its entirety.

BACKGROUND

1. Field of the Invention

The present invention relates to the field of hand tools, more particularly to the field of hand tools with pivotally attached handles.

2. Background of the Invention

As advanced engines become more compact to reduce weight, improve efficiency, and control cost in a competitive industry, the convenience and ease of engine maintenance may take second or lower priority. The result is that routine maintenance, such as replacement of spark plugs, can require the removal of a number of other components, or even the removal of the engine to access the spark plugs. Further, when engines are modified for higher performance, better fuel mileage, or for racing or other special applications, the additional equipment or larger components, such as special headers, take up the little remaining space and present further challenges to the routine maintenance of existing components. Spark plugs maintenance, in particular, may suffer from shrinking space availability in the engine compartment.

Existing spark plug wrenches are primarily designed for straight in access or right angle turning using the end of the spark plug socket, which encloses the spark plug. The resulting assembly is too long to allow use in the tightest locations in modern engines, requiring removal of other components to access the spark plugs.

Thus, there is a need for special tools, in particular, a spark plug wrench that can be used in the confined spaces found in today's advanced engines.

BRIEF DESCRIPTION OF THE INVENTION

Briefly, the invention relates to a spark plug installation and removal wrench comprising a short socket with a handle pivotally attached to the socket, forming a compact assembly that can access spark plugs in tight spaces. The socket may be rotated on the pivot axis to slip over the spark plug and down to engage and drive the spark plug. Lateral force on the handle may then rotate the socket to install or remove the spark plug. In one embodiment, the handle pivot axis may run through a clearance space for the spark plug, and the handle may have a U shape to avoid interference with the spark plug. An embodiment is disclosed wherein the handle may be attached with roll pins, rivets, screws or other pivot attachment hardware. In one embodiment, the pivot axis is above the bottom of the socket to allow the socket to access recessed spark plugs.

BRIEF DESCRIPTION OF THE FIGURES

The present invention is described with reference to the accompanying drawings. In the drawings, like reference numbers indicate identical or functionally similar elements. Additionally, the left most digit(s) of a reference number identifies the drawing in which the reference number first appears.

DETAILED DESCRIPTION OF THE PREFERRED EMBODIMENTS

The present invention is directed to a wrench which may be used to install and/or remove spark plugs, especially where the spark plugs are in confined or otherwise difficult to reach locations. In accordance with the invention, the wrench comprises a socket portion and a handle portion. The socket portion is very short, typically shorter than the spark plug. The handle portion couples to the socket portion, allowing the handle to assume a range of desired angles with respect to the spark plug axis. One embodiment is disclosed wherein the handle portion is coupled to the socket using a pivot, or hinge. The handle portion may include a forked, U shaped, yoke portion to avoid interference with the spark plug. The yoke portion may couple to the socket portion at two pivot hinge points, each on opposite sides of the socket. The short socket allows the wrench to fit in locations with interference very close to the spark plug. The yoke coupling on the handle allows the handle and pivot to be placed low on the assembly, even within the length of the spark plug. Thus, the socket and handle may be not much longer and possibly even shorter than the spark plug (with the handle angled 90 degrees to the socket axis)—allowing the socket and handle to operate in very tight spaces. In one embodiment, the pivot axis is a desired distance above the bottom end of the socket to allow the socket to reach into a recess to couple to the spark plug.

Figure 1A:
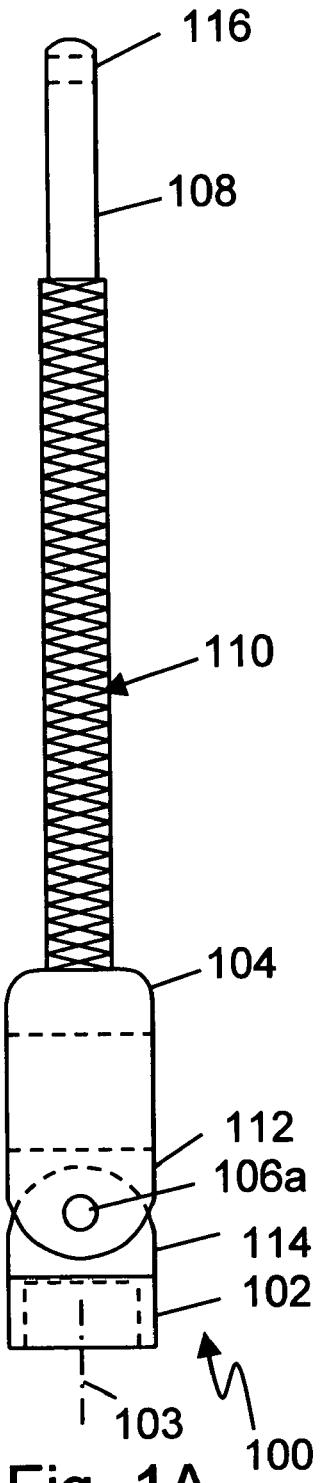
FIG. 1A illustrates a side view of an exemplary spark plug wrench in accordance with the present invention.

An exemplary embodiment of the present invention will now be described with reference to the figures. FIG. 1A illustrates a side view of an exemplary spark plug wrench in accordance with the present invention. Referring to FIG. 1A, the wrench comprises a socket portion 102 (also called a socket) and a handle portion 104 (also called a handle.) The socket portion 102 is pivotally attached and coupled to the handle portion 104 using pivot hinge including a pair of pivot pins 106*a* and 106*b* (106*b* shown in FIG. 2A). The pivot hinge allows the handle 104 to be pivoted to any angle from a position in line with the socket axis 103 (the position shown in FIG. 1A) to a position perpendicular to the socket axis 103 (not shown). (The socket axis 103 is essentially the rotation axis of a spark plug operated by the socket.) The socket 102 includes a flange 114, which forms part of the hinge. The handle 104 includes a flange 112 as part of the hinge. As shown, the handle 104 includes a first portion having a knurled finish 110 for better gripping. Other gripping finishes or coatings may be used. A second portion 108 of the handle shaft may be squared for use with an open end wrench. A hole 116 is provided in the end of the handle for hanging the wrench for storage.

Figure 2A:
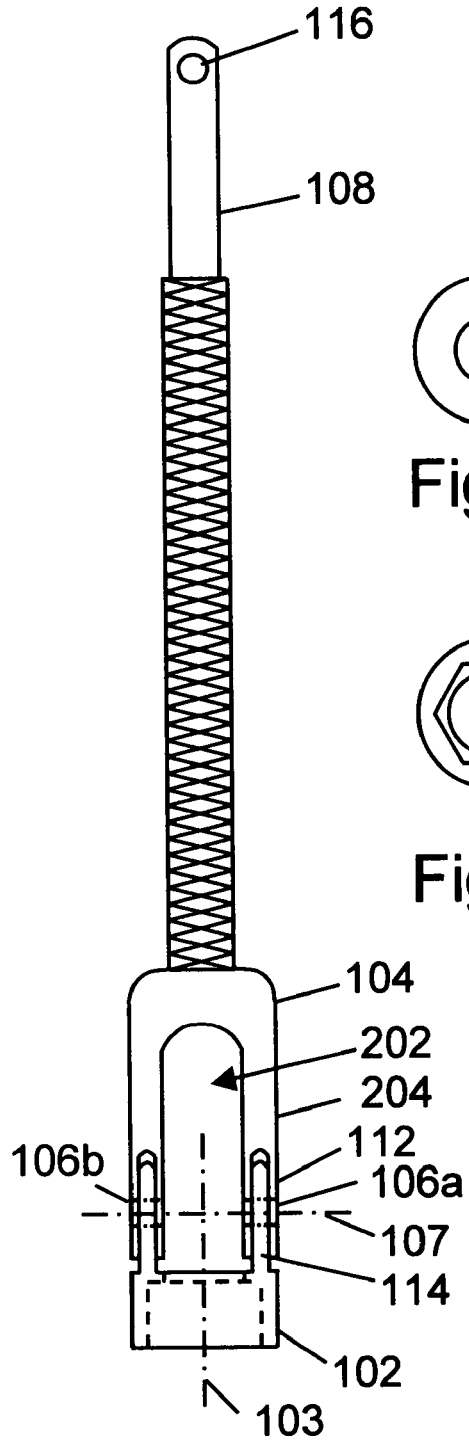
FIG. 2A is a front view of the wrench.

FIG. 2A is a front view of the wrench. Referring to FIG. 2A, the handle 104 is coupled to the socket 102 at two pivot points using two pivot pins 106*a* and 106*b*, one on each side of the socket. The handle 104 includes a U shaped yoke 204 that surrounds a space 202 available to be occupied by the spark plug to allow the handle to rotate up and over the spark plug if necessary. Each arm of the yoke 204 couples to a corresponding flange 114 on the socket. Each arm of the yoke 204 includes a double flange 112, one on each side of the socket flange 114 to balance the forces on the corresponding hinge pin 106*a*. Alternatively, the socket 102 may include dual flanges on each side and the handle may include a single flange on each side. In a further alternative, the socket and handle may each have a single flange on each side. Other hinge structures may be used as are known in the art.

In the preferred embodiment of FIG. 1A, the hinge axis is above the hex nut drive portion of the socket. Since a typical spark plug is mounted in a well or depression in the engine head, a slight elevation of the handle connecting point aids in accessing the recessed spark plug.

FIG. 2A also shows the hinge, including the coupling pins 106*a* and 106*b*, centered on the pivot axis 107. The pivot axis 107 is essentially transverse to the rotation axis 103 and typically may run through the space 202 which may be occupied by the spark plug (alternatively referred to as clearance space 202 for the spark plug). In one embodiment, the pivot axis 107 runs through the center of the spark plug space 202. In another embodiment, the pivot axis 107 is offset from the center of the spark plug space 202 (embodiment not shown.)

Figure 3:
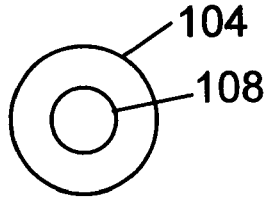
FIG. 3 is a top view of the wrench.

FIG. 3 is a top view of the wrench. FIG. 3 illustrates the overall circular shape of the handle yoke portion 104 and socket 102 and the smaller diameter of the knurled 110 handle portion. The handle end of the wrench is designated the top end for reference purposes throughout this disclosure. Conversely, the socket end is designated the bottom end.

Figure 4:
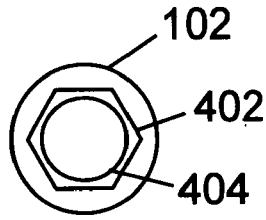
FIG. 4 is a bottom view of the wrench.

FIG. 4 is a bottom view of the wrench. FIG. 4 illustrates the circular outer diameter of the socket 102, the six point hex socket 402 for coupling to the spark plug, and the hole 404 at the top of the socket allowing the socket 102 to fit over the ceramic portion of the spark plug. The ceramic portion of the spark plug may protrude through the socket hole 404 into the space 202 between the arms of the yoke 204. A six point socket drive pattern is shown, but the socket may also be a twelve point drive pattern design. The drive pattern is for coupling to the spark plug for rotating the spark plug around the spark plug rotation axis. The twelve point socket design may allow more radial angle coupling opportunities with the spark plug, which would be an advantage in confined spaces.

Figure 2B:
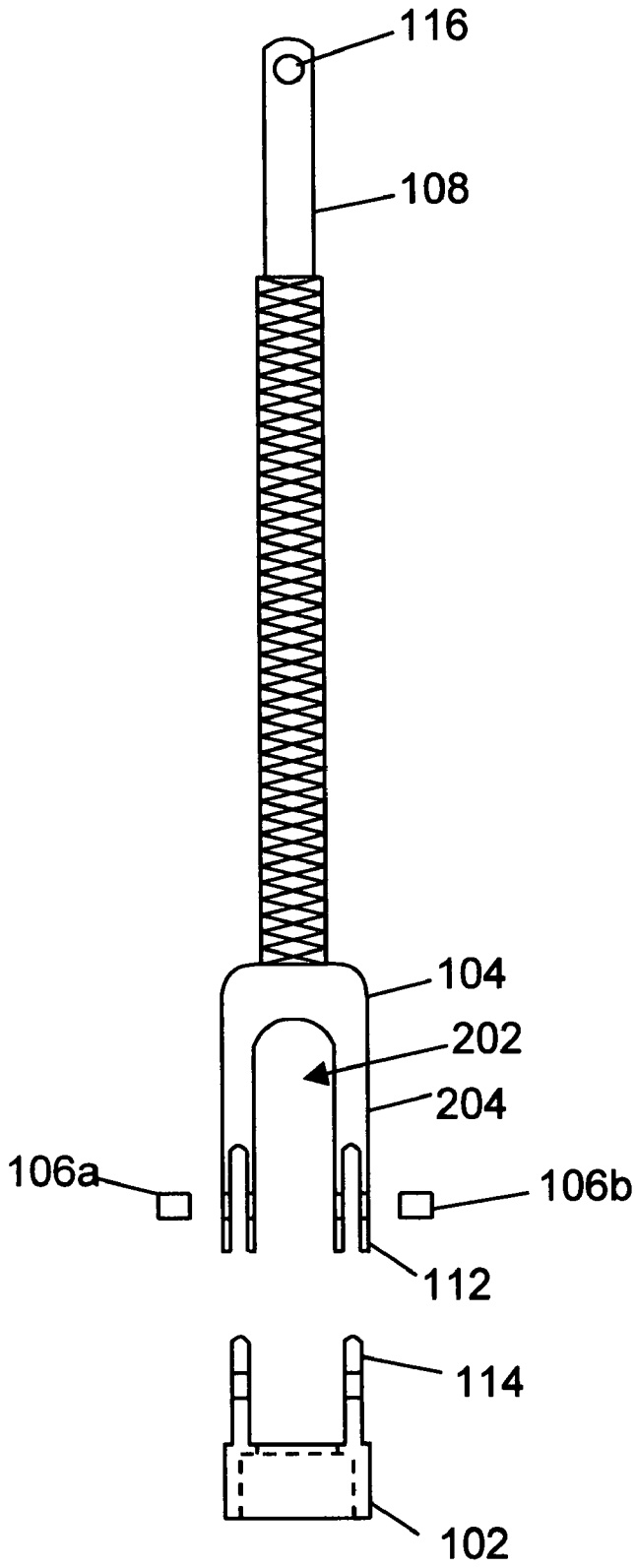
FIG. 2B is an exploded view of the wrench of FIG. 2A.

FIG. 2B is an exploded view of the wrench of FIG. 2A. FIG. 2B shows the separate physical components: the socket 102, the handle 104, and the two pivot pins 106*a* and 106*b*. In one embodiment, the pivot pins 106*a*, 106*b* are split steel pins, often called roll pins. In another embodiment, solid pins, or rivets, or shoulder screws may be used. In further embodiments, alternative pivoting structures may be used as are known in the art. The socket 102 may typically be shorter than the exposed portion of the spark plug and may be shorter than the exposed length including the insulator portion and excluding the connection terminal. The exposed portion is the portion exposed when the spark plug is mounted in an engine. The socket, being typically shorter than the spark plug, has a clearance space running through the socket to receive the spark plug. Although the wrench may be designed to accommodate a longer spark plug, the wrench may be used with a shorter spark plug. For illustrative purposes, the longer spark plug is shown in this disclosure.

Figure 1B:
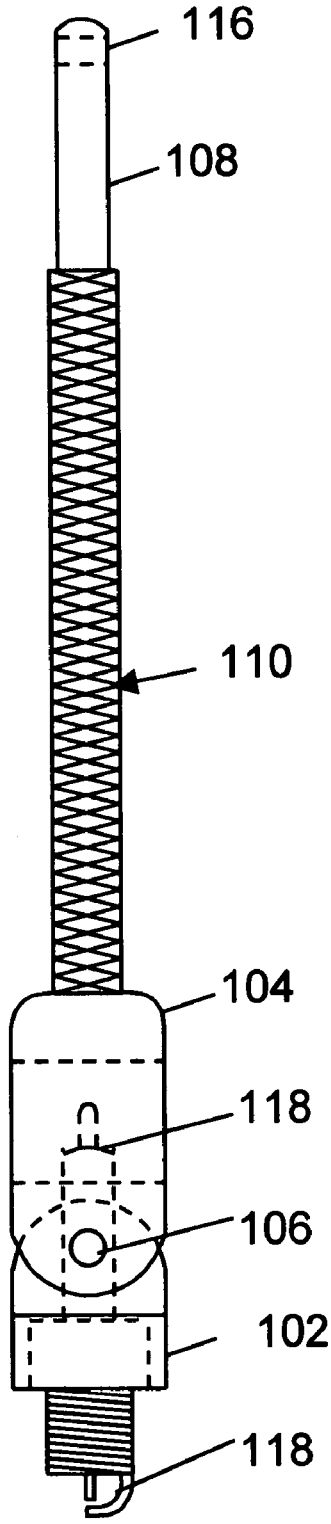
FIG. 1B illustrates the wrench of FIG. 1A coupled to a spark plug.

FIG. 1B illustrates the wrench of FIG. 1A coupled to a spark plug. Referring to FIG. 1B, the wrench of FIG. 1A is shown with the inclusion of a spark plug 118. The spark plug 118 is shown with the hex nut portion coupled to the socket 102 and the ceramic portion including connection electrode protruding into the space 204 between the yoke arms. It can be seen that the pivot axis 107 (center of pin 106*a*) is below the top of the spark plug 118. Typically, the pivot axis 107 may be described as intersecting the insulator portion of the spark plug.

Figure 5:
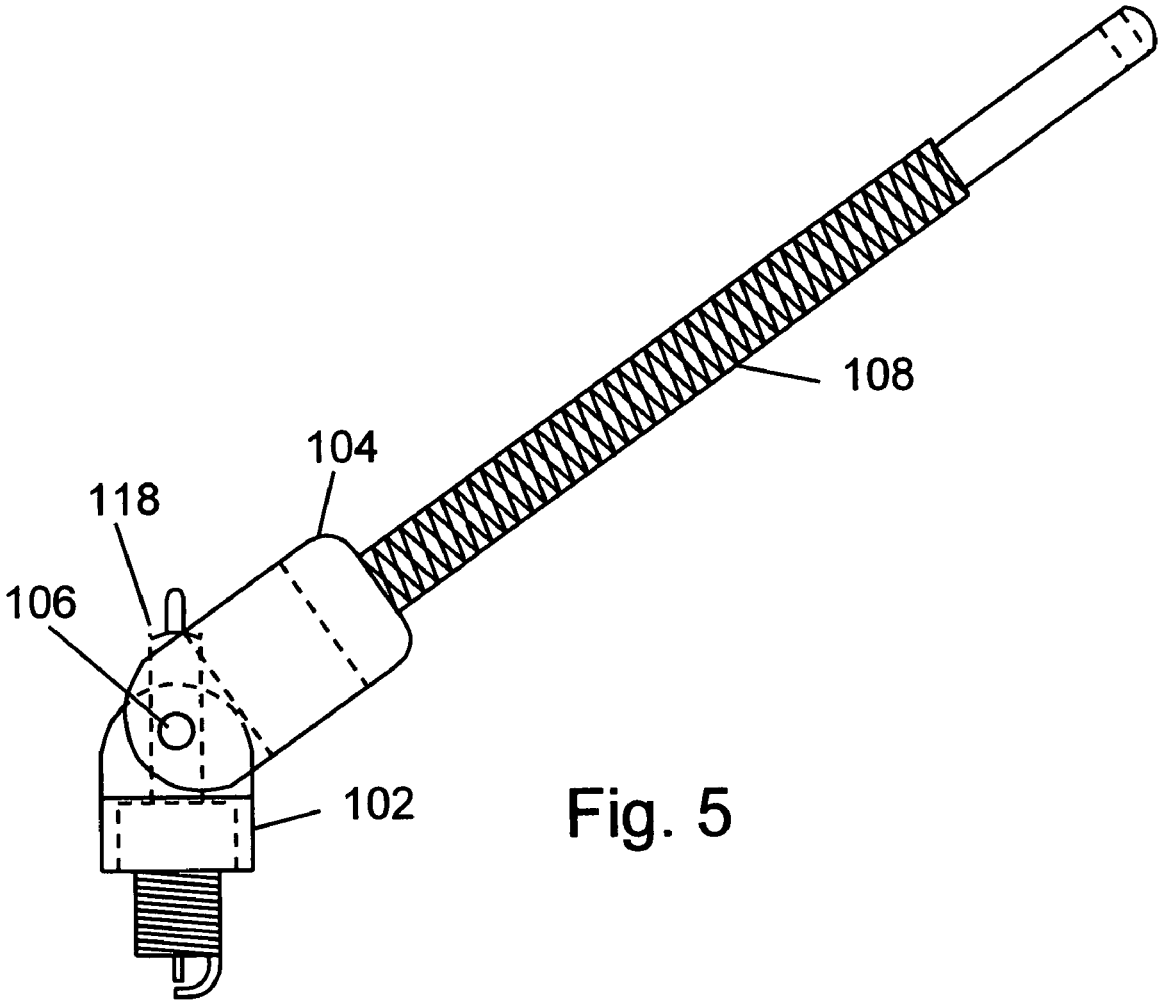
FIG. 5 illustrates the wrench and spark plug of FIG. 1B with the handle pivoted to an angle of about 45 degrees.

FIG. 5 illustrates the wrench and spark plug of FIG. 1B with the handle pivoted to an angle of about 45 degrees. The configuration of FIG. 5 represents a typical operation configuration for the wrench. A 90 degree angle (horizontal in FIG. 5) may be preferred for ideal application of torque to the spark plug, but may not be available due to interference with other engine components. Thus, the pivot hinge and yoke 204 with space 202 for the spark plug 118 allow the handle 104 to assume any angle from 90 degrees to 0 degrees, with respect to the spark plug 118 and socket 102 to best accommodate a wide range of engine configurations.

Figure 6:
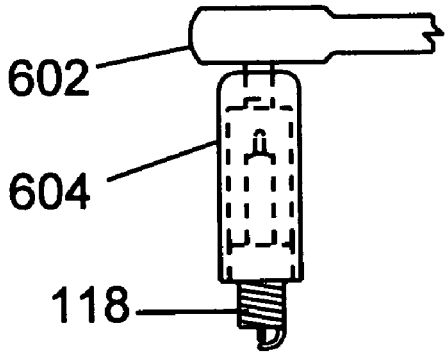
Fig. 6 (Prior Art)
FIG. 6 (prior art) illustrates a conventional spark plug wrench.

The advantages of the present invention may be better understood by comparison with the prior art. FIG. 6 (prior art) illustrates a conventional spark plug wrench. A typical prior art spark plug wrench comprises a specially designed socket 604 made to enclose the exposed portion of the spark plug 118. The prior art socket 604 includes a hex coupling at the bottom and a square wrench coupling at the top. The square wrench coupling couples to a standard ratchet wrench 602. One problem with the conventional spark plug wrench is that the length required for the prior art socket 604 and wrench 602 may not be available in a given automotive situation due to interference with engine components.

Figure 7:
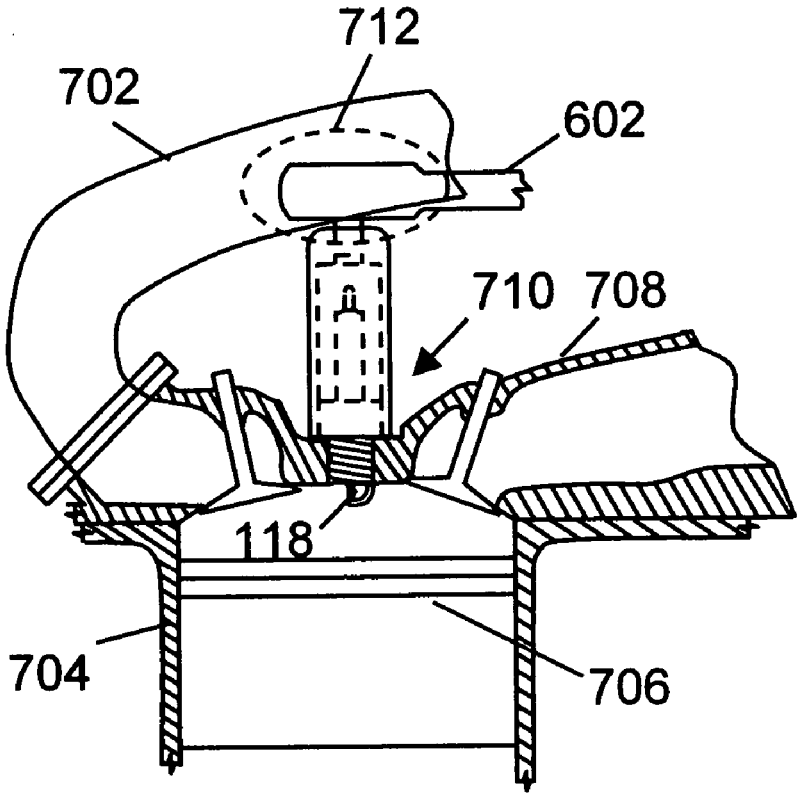
Fig. 7 (Prior Art)
FIG. 7 (prior art) illustrates a typical engine configuration showing the potential interference that prevents the use of the conventional spark plug wrench.

FIG. 7 (prior art) illustrates a typical engine configuration showing the potential interference that prevents the use of the conventional spark plug wrench. Referring to FIG. 7, a cylinder 704 is shown with associated components: the spark plug 118, a piston 706, a head 708, an exhaust header 702, and the conventional spark plug wrench 602 of FIG. 6. Note that the exhaust header 702 and the conventional spark plug wrench 602 must occupy the same physical space 712 in order to operate, thus preventing the use of the conventional spark plug wrench 602. In this situation, an open end wrench would often be used diagonally, partially coupling to the spark plug, risking damage to the spark plug. Alternatively, the header 702 may be removed for direct access to the spark plug, increasing the time and cost of repair.

Figure 8:
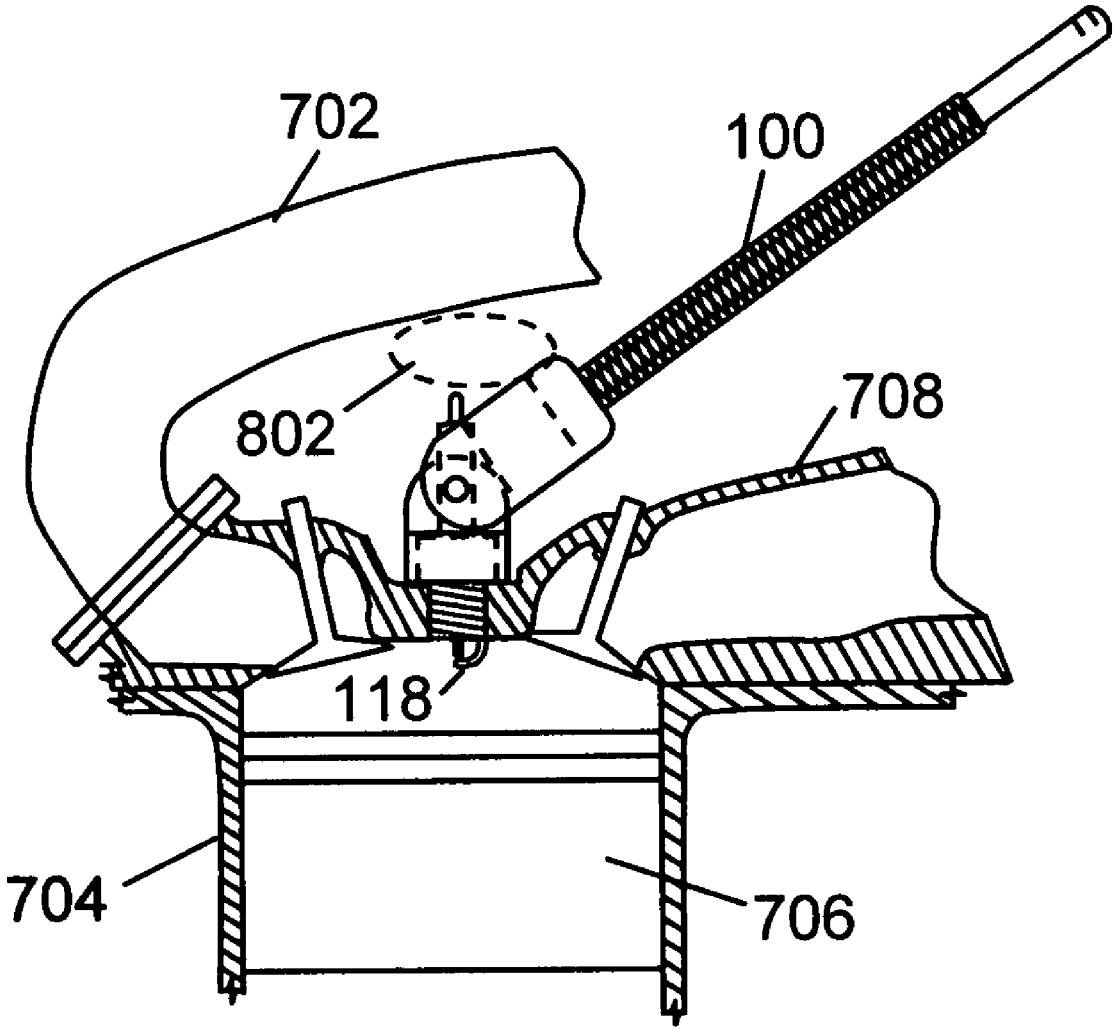
FIG. 8 illustrates the engine configuration of FIG. 7 with the operation of the wrench of FIG. 1A in accordance with the present invention.

FIG. 8 illustrates the engine configuration of FIG. 7 with the operation of the wrench of FIG. 1A in accordance with the present invention. Referring to FIG. 8, the wrench 100 fits easily into the space available, allowing clearance 802 above the spark plug 118 and below the header 702. The wrench 100 couples squarely to the spark plug 118, engaging all of the flats of the hex nut. The handle 104 is adjustable to a pivot angle where space is available to operate the wrench 100.

An installation procedure for the spark plug 118 in accordance with the present invention will now be described with reference to FIG. 8. The spark plug 118 may be initially inserted and tightened by hand. The socket portion 102 of the wrench 100 may then be slipped over the top of the spark plug 118, rotated at the pivot axis 107, and lowered to engage the hex nut of the spark plug 118. The spark plug 118 may then be turned by applying lateral force to the grip part of the handle 108 to further tighten the spark plug 118. The spark plug wrench 100 may then be removed by lifting the socket portion 102 up and rotating the socket portion 102 at the pivot axis 107 and then slipping the wrench 100 over the top of the spark plug 118 to remove the wrench 100. A procedure for removing the spark plug may follow the reverse of the installation procedure.

Fabrication of the wrench 100 may be done by conventional tool making techniques. The handle and socket may be made by forging followed by machining or grinding of critical surfaces. Other techniques may be used as are known in the art of tool making. The spark plug wrench may be preferably made of tool steel and finished with a hard chrome plating of tool quality, however, other finishes may be applied.

The wrench may be adapted to any size spark plug. Typical spark plug hex nut sizes include 9/16 inch (0.5625 inch, 14.8 mm), 5/8 inch (0.625 in, 15.8 mm), 11/16 (0.6875 inch, 17.4 mm), 13/16 inch (0.8125 in, 20.64 mm), and 3/4 inch (0.750 in, 19.05 mm). Typical metric hex nut sizes include 18 mm and 21 mm. In one embodiment, the same handle may be used with different sockets for different size spark plugs. In one embodiment adapted for a 5/8 inch spark plug, the narrow part of the handle may be 6 inches (15.2 cm) in length with 1.5 inches (3.8 cm) square cross section (0.3125 inch 7.9 mm square) with the remaining 4.5 inches (11.4 cm) knurled for better grip (0.375 inch diameter (9.5 mm)). The yoke may be 2 inches (5.08 mm) in length and the socket may be 0.5 inch (12.7 mm) in length, excluding hinge flanges, and 0.875 inch (22.2 mm) outside diameter. The socket flange may be 0.7 inch (18 mm) in length, extending the socket to 1.2 inches (30.5 mm) overall. Typically, the socket may be less than 5 cm in overall length. The pivot axis may be 0.90 inch (23 mm) above the bottom of the socket. Typically, the pivot axis may be greater than one centimeter from the bottom of the socket.

A typical spark plug may have an exposed length of from 1.0 to 2.25 inches (2.54 to 5.7 cm.) The exposed length is the length from the seating surface to the end of the connection electrode and includes the hex nut and ceramic portion, i.e., the portion that is exposed when the spark plug is installed in an engine.

In an alternative embodiment, the handle may be curved, or the grip portion of the handle (the knurled portion) may be offset from center or both. In a further alternative, the pivot axis may be offset from the center of the spark plug. With a slight increase in size of the socket, the pivot axis may be off center sufficiently that the pivot axis does not pass through the space for the spark plug.

In a further alternative, a ratchet mechanism may be provided between the pivot and the socket. The ratchet mechanism may be provided with a clearance hole allowing the ceramic portion of the spark plug to protrude through the center of the ratchet.

In a further alternative, a rubber pad in the form of a tube or ring may be provided to hold a spark plug and/or provide padding for the ceramic portion of the spark plug. Alternatively, the spark plug may be retained by a friction spring.

Alternative Embodiment

Figures 9A, 9B, 9C, 9D, 9E:
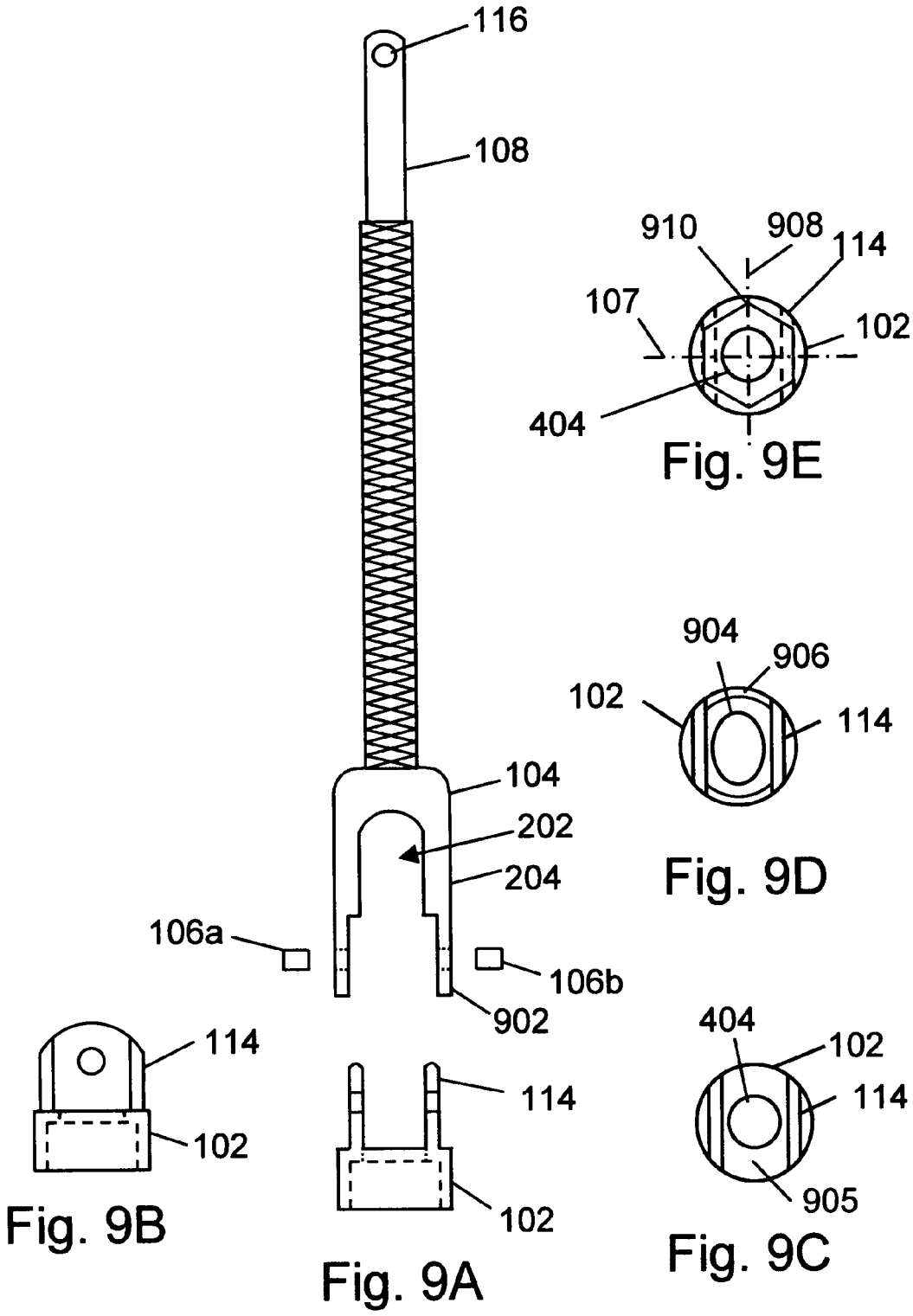
FIGS. 9A-9E show an alternative embodiment illustrating additional features and variations.

FIGS. 9A-9E show an alternative embodiment illustrating additional features and variations. Referring to FIG. 9A, the forked handle includes a single flange 902 for the hinge connection with the socket rather than the double flange arrangement 112 shown in FIG. 2B. The single flange 902 of the handle couples preferably to the outside of the socket flange 114. Alternatively, the handle flange 902 may couple to the inside of the socket flange 114. The coupling pin 106*a*, 106*b* may be a press fit pin, or may be welded or threaded or otherwise fixed to either the socket or handle, while being free to rotate on the other component, allowing the socket to freely rotate relative to the handle.

FIG. 9B shows the socket 102 rotated to view the side of the hinge flange 114.

FIG. 9C and FIG. 9D are top views of the socket illustrating alternative hole configurations for a partition flange between the socket drive pattern and the hinge flanges. FIG. 9C and FIG. 9D show the socket body 102 including the hinge flanges 114 and a hole 404, 904 for receiving the insulator portion of a spark plug. A partition flange 905 is shown forming a top surface above the socket drive pattern. The partition flange hole may be a round hole 404 or another shape 904. The hole should be large enough to accommodate the insulator portion of the spark plug at a substantially diagonal entry angle relative to the socket 102. Thus, the hole should be somewhat larger than the insulator in at least one dimension. The hole 904 may be oval as shown in FIG. 9D. The oval shaped hole 904 may be elliptical or a race track slot (semicircle ends with straight sides), or may be rectangular, or other shape as desired. It is desirable to keep some material in the partition flange 905 at the end of the hole to add strength to the socket.

The socket hinge flanges 114 are preferably parallel and preferably have no connecting web flange material. Alternatively, some connecting web flange material 906 may be used, as illustrated in FIG. 9D, but the connecting web flange 906 should be short in height so as not to interfere with overhead obstructions during insertion of the wrench and not to limit the maximum diagonal angle achievable with respect to the spark plug insulator.

FIG. 9E shows a bottom view of an exemplary socket in accordance with the present invention. FIG. 9E shows a six point, hexagonal, socket engage (rotation drive) pattern. Hinge flanges are shown dashed because they are hidden on the opposite side of the socket. The circular hole is shown. The socket engage pattern may be typically a six point or twelve point pattern for engaging the hex nut on a typical spark plug. For allowing maximum diagonal angle of the spark plug, it is desirable to align the notch (vertex) of the engage pattern so that a plane 908 through the center of the socket and parallel to the socket hinge flanges 114 passes through the vertex 910 of one of the notches, allowing maximum tilt of the socket relative to the spark plug. The plane 908 may also be characterized as perpendicular to the handle hinge rotation axis 912.

Figure 10A:
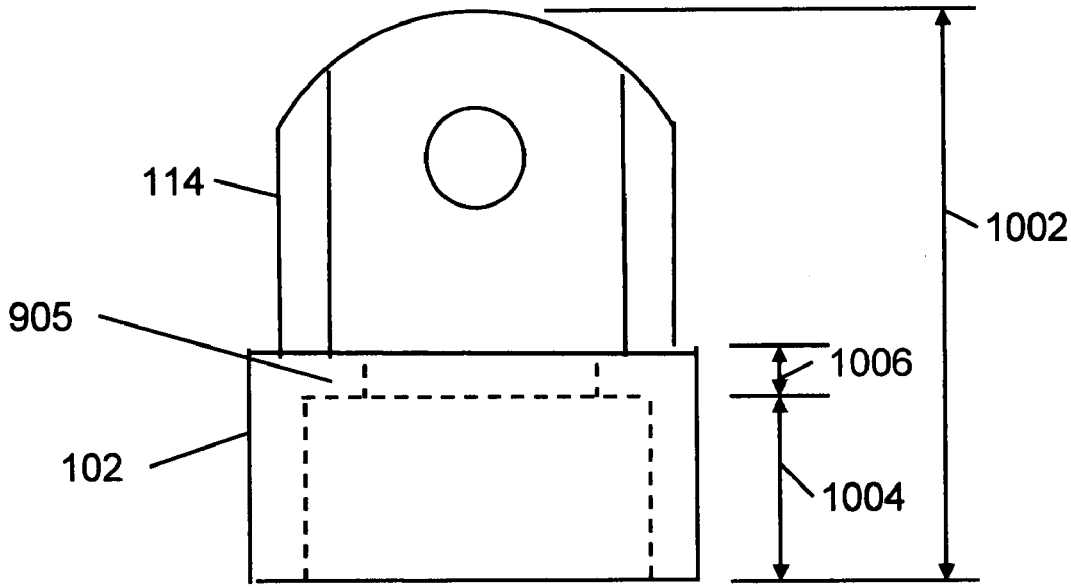
FIGS. 10A and 10B illustrate dimensions for an exemplary socket in accordance with the present invention.
Figure 10B:
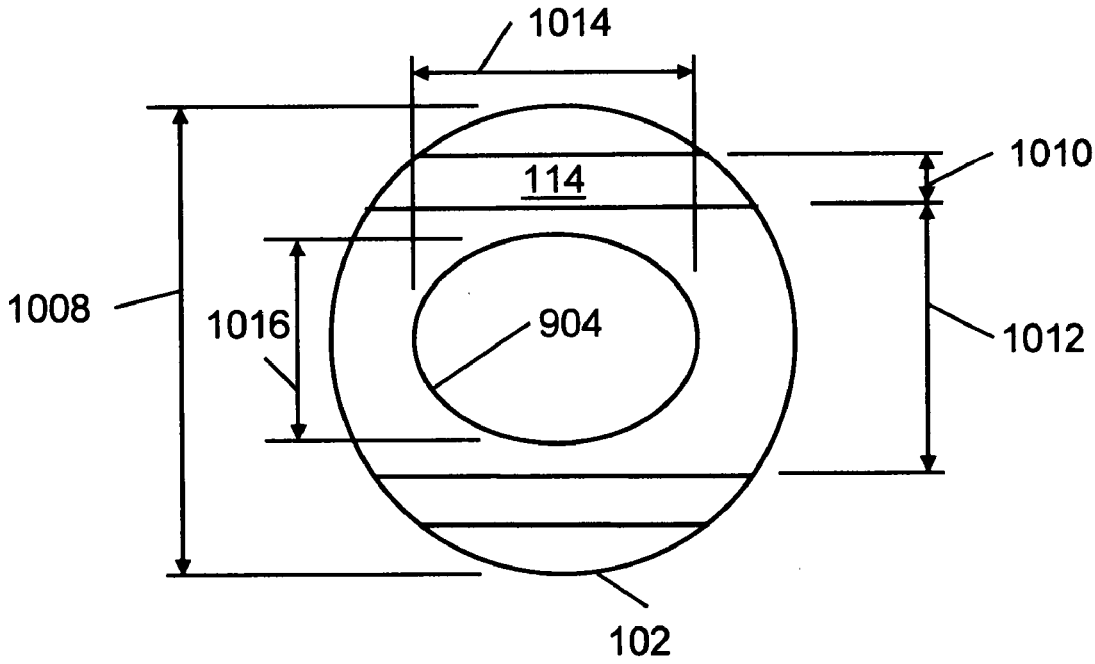

FIGS. 10A and 10B illustrate dimensions for an exemplary socket in accordance with the present invention.

An exemplary wrench for a 5/8 inch or larger socket size spark plug may be dimensioned as follows: the height of the socket 1002 may be preferably 1.2 inches (3.05) cm. One may vary the height 1002 as desired from 1 inch (2.54 cm) or less to 2 inches (5.08 cm). Shorter lengths are increasingly preferred from less than 2 inches (5.08 cm), less than 1.5 inches 3.81 cm), less than 1.4 inches (3.56 cm), less than 1.3 inches (3.3 cm). Height less than 1.2 inches are less preferred because of the need to reach into a depression or well to engage some spark plugs. Thus, less than 1.1 inch (2.8 cm) is less preferred, less than 1 (2.54 cm) inch is even less preferred.

The exemplary wrench may include a 0.400 inch (1 cm) deep drive pattern (dimension 1004) and a 0.100 inch (2.5 mm) partition flange width 1006. The drive pattern may be less or more deep, as desired.

A typical ⅝ inch spark plug may have a 0.425 inch diameter insulator, 1.0 inch long with a 2.5 inch diameter electrode 0.5 inch long. The wrench may have a 0.45 inch hole 404 for the electrode and the inside separation 1012 of the socket hinge flanges 114 may be 0.45 inches apart. The socket flange 114 thickness 1010 may be 0.100 inch. An oval hole may have a major diameter 1014 of 0.5 inch to 0.6 inch and a minor diameter 1016 of 0.45 inch. The outside diameter 1008 of the socket may be 0.880 inch with a 0.075 inch minimum wall thickness at the verticies of the engage pattern.

Exemplary changes from the ⅝ socket to other sizes include changing the drive pattern size, and the hole for the insulator and the spacing for the hinge flanges. Other dimensions including wall and member thicknesses may remain similar. The drive pattern length of 0.400 inch, 1 cm and overall length of 1.2 inches, 3 cm, is sufficient for 11/16, ¾, 13/16, and 18 and 21 mm sizes. The insulator for a ¾ or 13/16 spark plug may be ½ inch in diameter at the base and may taper or step down in diameter. Thus the hole for a ¾ or 13/16 spark plug may be 0.550 or greater. The spacing of the flanges may also be 0.550 or greater.

Figure 11A:
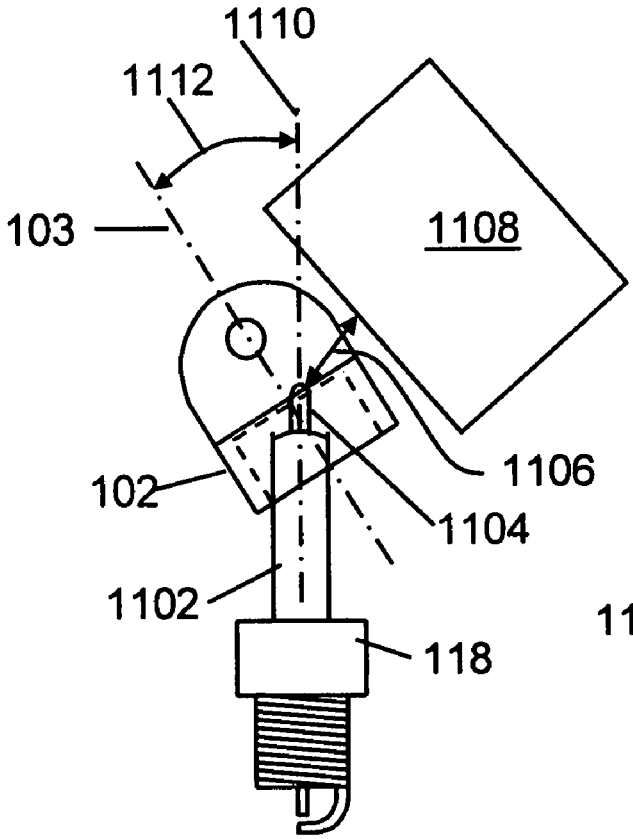
FIG. 11A illustrates a first exemplary engagement configuration for an exemplary wrench.

FIG. 1A illustrates a first exemplary engagement configuration for an exemplary wrench. Referring to FIG. 11A, shown is the exemplary spark plug 118 having a ⅝ inch nut, a 0.425 inch diameter insulator 1102, 1.0 inch long with a 2.5 inch diameter terminal 1104, 0.5 inch long. Also shown, an exemplary wrench socket 102 (handle 104 not shown for simplicity), and an exemplary overhead interfering object 1108 disposed a distance 1106 from the terminal 1104 of the spark plug, at an angle 1118 from the spark plug rotation axis. The socket 102 is shown upon first insertion over the plug 118. The partition hole 404 perimeter is in contact with the top of the plug terminal 1104 and the socket drive pattern is in contact with the side of the insulator 1102. In this first position, the axis of the socket 1114 forms a first entry angle 1112 with the spark plug axis 1110. This first entry angle 1112 may also be called a diagonal angle 1112 and may be 31 degrees for the exemplary ⅝ socket 102 and spark plug 118 just dimensioned above. Thus, for variations in the socket, this angle 1112 may be greater than 20 degrees, or greater than 25 degrees, or for a shorter socket or larger or oval hole, the angle 1112 may be greater than 35 degrees. In the configuration of FIG. 11A, the wrench 102 may clear the flat overhead object 1108 oriented at 45 degrees 1118 with respect to the spark plug axis 1110 to within a clearance spacing 1106 of 0.375 inches, less than 1 cm. For spark plug drive sizes greater than ⅝ inch, the socket may be wider and have the same length, thus the angle 1112 may be equal or greater than the angles for the ⅝ socket and the clearance spacing 1106 may be equal or less than for the ⅝ inch socket.

Figure 11B:
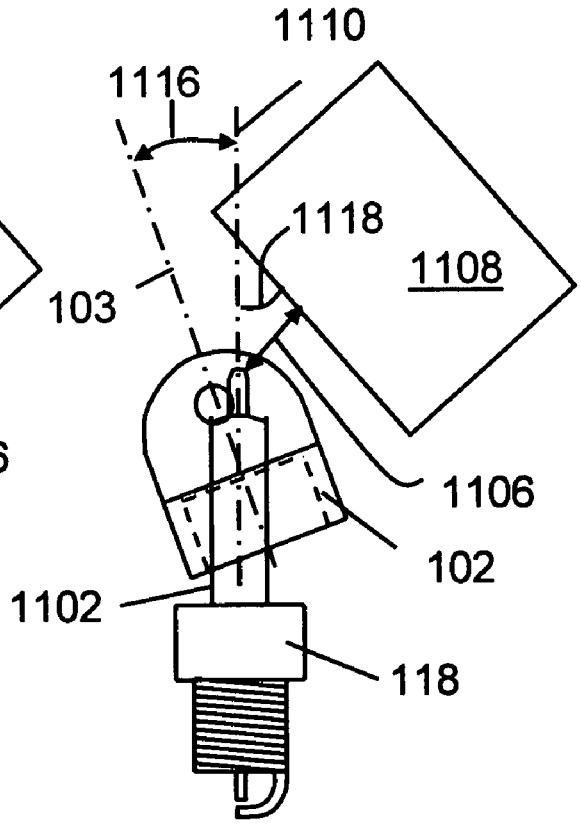
FIG. 11B illustrates a second exemplary engagement configuration for an exemplary wrench.

FIG. 11B illustrates a second exemplary engagement configuration for the exemplary wrench. FIG. 11B shows the socket partition hole 404 in contact with the spark plug insulator 1102 on a first side of the insulator and socket drive pattern in contact with the spark plug insulator 1102 on the opposite side of the insulator. In this second configuration, the socket axis 1114 makes a second angle 1116 with the spark plug axis 1110. The second angle 1116 may be 18 degrees for the exemplary ⅝ socket 102 and spark plug 118. A longer socket 102 may make a smaller maximum angle 1116, which may be greater than 10 or 15 degrees. A shorter socket 102 (drive pattern length 1004) and larger hole 404 or oval hole 904 may increase the angle 1116, which may be greater than 20 or 25 degrees. The first diagonal angle 1112 may preferably be at least 20 degrees and may be greater than 30 degrees using the socket dimensions above. The second diagonal angle 1116 may be at least 10 degrees and may preferably be greater than 15 degrees using the socket dimensions above. Using the socket dimensions above, the wrench 100 may be capable of insertion over the exemplary spark plug 118 with a flat overhead interference 1108 at a 45 degree angle 1118, and the clearance spacing 1106 is 0.375 inches (closer than 1 cm) from the spark plug terminal. For spark plug drive sizes greater than ⅝ inch, the socket may be wider and have the same length, thus the angle 1116 may be equal or greater than the angles for a ⅝ socket and the clearance spacing 1106 may be equal or less than for the ⅝ inch socket.

The wrench 100, being intended for spark plugs need not have the torque capability of a general purpose wrench. A typical spark plug torque requirement for tightening a spark plug is 20 ft lbs to 25 ft lbs (foot-pounds force) (27-34 Newton meters, Nm) with some spark plugs specified at 32 ft lbs (43 Nm). Thus, in one embodiment, the wrench need not have a capability of greater than 40 ft lbs (54 Nm) or, with increasing margin, greater than 50 ft lbs (68 Nm) or greater than 75 ft lbs (102 Nm).

CONCLUSION

Thus, herein described is an improved spark plug wrench that can be used in the confined spaces found in today's advanced engines.

While particular embodiments of the invention have been described, it will be understood, however, that the invention is not limited thereto, since modifications may be made by those skilled in the art, particularly in light of the foregoing teachings. It is, therefore contemplated by the appended claims to cover any such modifications that incorporate those features or those improvements which embody the spirit and scope of the present invention.

What is claimed is:

1. A wrench for a spark plug, said wrench comprising:

a socket having a single rotation drive pattern, said rotation drive pattern disposed on a first end of said socket for coupling to said spark plug, said rotation drive pattern having a rotation axis, said rotation drive pattern for a spark plug nut of size ⅝ inch or larger said socket having a first clearance space through said socket for receiving said spark plug;

said socket having an attachment flange arrangement formed as a single unit with said socket at a second end of said socket, said attachment flange arrangement having two flange components on opposite sides of said socket, said first clearance space extending between said two flange components;

said socket having an overall length including said attachment flange arrangement of less than 3.5 centimeters; and a handle pivotally attached to said two flange components by a pivotal attachment having a pivot axis transverse to said rotation axis and passing through each of said two flange components and through said first clearance space extending between said two flange components;

said handle having a second clearance space for avoiding said spark plug;

said handle coupling to said two flange components at two locations, one said location at each of said two flange components.

2. The wrench of claim 1, wherein the drive pattern is a six point pattern or a twelve point pattern.

3. The wrench of claim 1 wherein the pivot axis is greater than or equal to one centimeter from the bottom end of the socket.

4. The wrench of claim 1, wherein the handle is coupled to the socket through a U shaped yoke.

5. The wrench of claim 1, further including a partition flange between said rotation drive pattern and said attachment flange arrangement, said partition flange having a hole for receiving said spark plug wherein said hole is round, oval, or rectangular.

6. The wrench of claim 5, wherein said two flange components are parallel.

7. The wrench of claim 5, wherein said flange arrangement includes no connecting web flange between said two flange components.

8. The wrench of claim 5, wherein said drive pattern has a notch oriented such that a plane perpendicular to said pivot axis and passing through the center of said socket also passes through the vertex of said notch.

9. The wrench of claim 5, wherein said rotation drive pattern is sized for a ⅝ inch or larger nut on said spark plug and the overall length of said socket including said two flange components is 3 cm or less.

10. The wrench of claim 9, wherein said overall length is 2.5 cm or less.

11. The wrench of claim 5, wherein said rotation drive pattern is 1 cm or less in length.

12. The wrench of claim 5, wherein said socket is capable of insertion of a spark plug at a substantial diagonal angle to avoid interference with an overhead object.

13. The wrench of claim 12, wherein the substantial diagonal angle is greater than 10 degrees.

14. The wrench of claim 12, wherein the substantial diagonal angle is greater than 20 degrees.

15. The wrench of claim 5, wherein the socket is capable of insertion over a spark plug having a flat overhead interference object oriented 45 degrees from a spark plug rotation axis and disposed within 1 cm from a terminal portion of said spark plug, said spark plug having an insulator portion 0.425 inch (10.8 mm) in diameter with a terminal 0.25 inch (6.35 mm) in diameter and 0.5 inch (12.7 mm) long.

16. A method for operation of the wrench of claim 9 comprising:

inserting the wrench over the top of said spark plug such that an insulator portion of the spark plug contacts the socket at two points, at one said point, contacting the rotation drive pattern and at the other said point, contacting said partition flange such that the rotation axis of the rotation drive pattern forms a substantial diagonal angle with a rotation axis of said spark plug, and said substantial diagonal angle is greater than 10 degrees;

coupling the wrench to the spark plug; and turning the wrench to tighten or loosen the spark plug, said insulator portion 0.425 inch (10.8 mm) in diameter.

17. The method of claim 16, wherein the substantial diagonal angle is greater than 15 degrees.

18. A method for operation of the wrench of claim 9 comprising:

inserting the wrench over the top of said spark plug such that the spark plug contacts the socket at two points, one said point wherein an insulator portion contacts the rotation drive pattern and the other said point wherein a terminal portion contacts the partition flange such that the rotation axis of the rotation drive pattern forms a substantial diagonal angle with a rotation axis of said spark plug said substantial diagonal angle is greater than 20 degrees;

coupling the wrench to the spark plug; and turning the wrench to tighten or loosen the spark plug, said insulator portion 0.425 inch (10.8 mm) in diameter, said terminal 0.25 inch (6.35 mm) in diameter and 0.5 inch (12.7 mm) long.

19. The method of claim 18, wherein the substantial diagonal angle is greater than 30 degrees.

20. The method of claim 18, wherein the wrench has a torque rating less than 102 Newton-meters.

* * * * *